United States Patent [19]

Sakai et al.

[11] 4,126,472

[45] Nov. 21, 1978

[54] PROCESS OF MAKING A LITHOGRAPHIC PHOTOSENSITIVE SILVER HALIDE EMULSION HAVING REDUCED SUSCEPTIBILITY TO PRESSURE CONTAINING AN IRIDIUM COMPOUND, A HYDROXYTETRAZAINDENE AND A POLYOXYETHYLENE

[75] Inventors: Takeo Sakai; Tadashi Ogawa, both of Minami-ashigara, Japan

[73] Assignee: Fuji Photo Film Co., Ltd., Minami-ashigara, Japan

[21] Appl. No.: 770,143

[22] Filed: Feb. 18, 1977

Related U.S. Application Data

[63] Continuation of Ser. No. 552,901, Feb. 25, 1976, abandoned.

[30] Foreign Application Priority Data

Feb. 24, 1974 [JP] Japan ..... 49-22134

[51] Int. Cl.[2] ..... G03C 1/30

[52] U.S. Cl. ..... 96/110; 96/95; 96/107; 96/109

[58] Field of Search ..... 96/107, 108, 95, 110, 96/109

[56] References Cited

U.S. PATENT DOCUMENTS

| | | | |
|---|---|---|---|
| 2,448,060 | 8/1948 | Smith et al. | 96/108 |
| 3,333,959 | 1/1967 | Hayakawa et al. | 96/107 |
| 3,445,235 | 5/1969 | Burt | 96/95 |
| 3,765,901 | 10/1973 | Schellekens et al. | 96/95 |
| 3,775,128 | 11/1973 | Yamamoto et al. | 96/109 |
| 3,847,618 | 11/1974 | Hofman et al. | 96/95 |
| 3,891,442 | 6/1975 | Beavers | 96/95 |

FOREIGN PATENT DOCUMENTS

| | | | |
|---|---|---|---|
| 602,158 | 5/1948 | United Kingdom | 96/110 |
| 748,750 | 5/1956 | United Kingdom | 96/110 |

*Primary Examiner*—Won H. Louie, Jr.
*Attorney, Agent, or Firm*—Sughrue, Rothwell, Mion, Zinn and Macpeak

[57] ABSTRACT

A method of producing a lithographic photosensitive material comprising adding a water soluble iridium compound to the photographic emulsion in a ratio of about $10^{-6}$ to $10^{-4}$ mole per mole of the silver halide at the first or second ripening procedure of a silver halide photographic emulsion containing at least 60 mole% silver chloride, further adding a hydroxytetrazaindene compound and a polyoxyethylene compound to the photographic emulsion and coating the photographic emulsion on a support.

10 Claims, 8 Drawing Figures

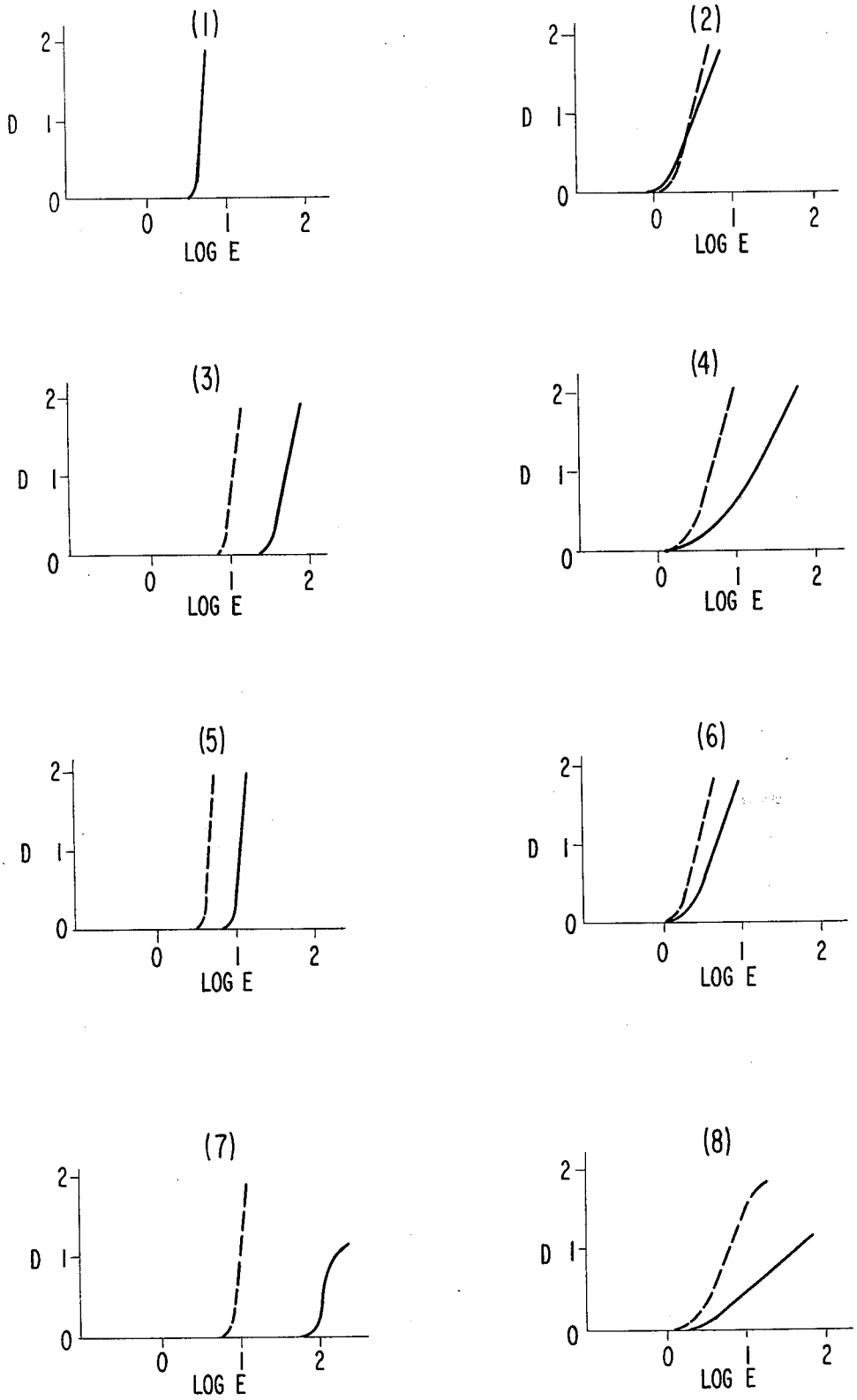
(1)
(2)
(3)
(4)
(5)
(6)
(7)
(8)
D
LOG E
0
1
2

PROCESS OF MAKING A LITHOGRAPHIC PHOTOSENSITIVE SILVER HALIDE EMULSION HAVING REDUCED SUSCEPTIBILITY TO PRESSURE CONTAINING AN IRIDIUM COMPOUND, A HYDROXYTETRAZAINDENE AND A POLYOXYETHYLENE

This is a continuation of application Ser. No. 552,901, filed Feb. 25, 1976, now abandoned.

BACKGROUND OF THE INVENTION

1. Field of the Invention

This invention relates to a method of producing a lithographic photosensitive material and particularly of producing lithographic photosensitive materials which have improved characteristics with respect to pressure susceptibility.

2. Description of the Prior Art

When the photosensitive coating of a photographic material is subjected to pressure either by folding, curving or bending the material at a sharp angle or by scratching the material against a sharp substance, the area thereof subjected to these actions often exhibits an increased or decreased photographic sensitivity. These phenomena give rise to so called "pressure marks" or "scratch marks" fatally deteriorating the final photographic image. Hence, preventing the generation of pressure or scratch marks by reducing the susceptibility of a photographic material to pressure is desired.

Generally speaking, a photographic material designed to reproduce a line and half-tone dot image includes a certain cadmium compound to increase the photographic speed as well as the gamma. However, the cadmium salt dissolves into the processing solution during processing, thus causing a severe pollution problem with respect to processing wastes. Therefore photographic materials free of cadmium compounds are highly desirable. Unfortunately, those photographic materials which do not contain a cadmium salt not only tend to exhibit a slow speed and a low gamma value, but also are quite susceptible to pressure, with the above-mentioned "pressure or scratch marks" being formed very easily.

On the other hand, such a photographic material is usually developed with a so-called infectious developer whereby the presence of a polyoxyethylene compound can improve, as is well known, the dot quality and contrast characteristics. If, however, the polyoxyethylene compound is contained in the photographic material, an increased number of pressure or scratch marks due to a localized sensitivity reduction tends to appear, especially where the photographic material does not contain a cadmium salt. In order to suppress the susceptibility to pressure of a photographic material, the incorporation therein of any of a water soluble polymer, a latex of a water insoluble polymer and a humectic material such as an alcohol or glycerol as a gelatin plasticizer has been proposed. Although such a plasticizer can reduce the pressure marks caused by folding, curving or bending the material at a sharp angle, it is not effective to suppress scratch marks generated when the material is rubbed against a minute protrusion. In addition, the plasticizer tends to cause the gelatin layer after processing to be hazy and to make the surface of the coating tacky.

SUMMARY OF THE INVENTION

A principal object of the present invention is to provide a method of producing photographic materials with an improved pressure susceptibility.

A second object is to provide a method of producing photographic materials in which the generation of pressure marks as well as scratch marks are prevented.

A third object is to provide a method of producing photographic materials for lithographic use in which the generation of pressure marks as well as scratch marks is prevented and which have improved pressure susceptibility.

The above cited objects of the present invention are attained by ripening a silver halide photographic emulsion containing at least 60 mole% silver chloride in the presence of about $10^{-6}$ to $10^{-4}$ mol of a water soluble iridium salt per mole of the silver halide, further adding a hydroxytetrazaindene compound and a polyoxyethylene compound to the photographic emulsion and then coating the resulting photographic emulsion onto a support.

BRIEF DESCRIPTION OF THE DRAWING

The figures illustrate the characteristic curve of photographic materials prepared by the method in accordance with the present invention and comparative methods, FIG. 1 being the former and FIGS. 2 to 8 the latter. The Figure numbers correspond to the sample numbers used in Example 1. In the figures, the dotted lines correspond to the area which was not pressed and the solid lines to the area which was pressed.

DETAILED DESCRIPTION OF THE INVENTION

In general, the production of a silver halide photographic emulsion comprises the four main steps of (1) formation of a silver halide precipitate, (2) physical ripening, (3) removal of excessive salts (desalting procedure), and (4) chemical ripening (second ripening). In the present invention, a water soluble iridium salt is added to the photographic emulsion at either of the first or second ripening. The iridium compound thus added will be present on or near the surface of the silver halide crystals and thus can exert a desirable effect together with the hydroxytetrazaindene and the polyoxyethylene compound which are added subsequently. If the iridium salt is added during the formation of the silver halide precipitate, the iridium salt will be located inside the silver halide crystals, and if the iridium salt is added at the desalting step, the iridium salt with not be present in the photographic emulsion since the iridium salt will be removed by the water used in the desalting procedure. Thus, in either case, the desirable effects achieved in the present invention are not obtained. To achieve the effects of this invention, the iridium compound can be added to the first ripening and the first ripening can be carried out at about 40° to 75° C., preferably 50° to 70° C., for about 2 to 60 minutes, preferably 5 to 30 minutes, or can be added to the second ripening and the second ripening can be carried out at about 45° to 75° C., preferably 50° to 70° C., for about 20 to 120 minutes, preferably 30 to 100 minutes.

The water soluble iridium compounds which can be used in the present invention include water soluble iridium salts and water soluble iridium complex salts, including iridium trihalides, iridium tetrahalides, hexahaloiridium (III) salts, hexahaloiridium (IV) salts, etc.

Some specific examples of iridium salts are $IrCl_3$, $IrBr_3$, $IrI_3$, $IrCl_4$, $IrBr_4$, $K_3IrCl_6$, $Li_3IrCl_6$, $(NH_4)_3IrCl_6$, $K_3IrBr_6$, $Na_3IrBr_6$, $K_2IrCl_6$, $Na_2IrCl_6$, $Li_2IrCl_6$, $(NH_4)_2IrCl_6$, $Na_2IrBr_6$, $Ir(NH_3)_6(OH)_3$, $Ir(NH_3)_6(NO_3)_3$, $Ir(NH_3)_6Cl_3$, $Ir(NH_3)_6Br_3$, etc.

It is already known in the art that water soluble iridium compounds can be added to a photographic emulsion for various purposes, and specific examples of iridium compounds are disclosed in a number of previous patent specifications, which one can consult even for the present invention. However, the present invention is distinguished from these previous techniques, since the purpose of the addition of the iridium compound is quite different. Some of these preceeding techniques already known are described, for example, in U.S. Pat. Nos. 2,566,245 and 2,566,263 in which the iridium salt is used as a stabilizing agent, U.S. Pat. Nos. 2,448,060, 3,318,702, 3,320,068, 3,326,690, and *British Journal of Photography,* Vol. 59, No. 106, p.147 in which the iridium compound is used as a sensitizer, and Japanese Patent Publication No. 4935/1968 in which the iridium compound is used as an agent for preventing a reduction in gamma, etc.

For the purposes of the present invention, the water soluble iridium compound is preferably employed in a ratio of about $10^{-6}$ to $10^{-4}$ mole per mole of silver halide. Below about $10^{-6}$ mole no effect is observed, while above about $10^{-4}$ mole a detrimental influence appears on photographic speed. Thus, the range of the iridium compound employed is quite important in the present invention.

After the addition of the iridium compound, a hydroxytetrazaindene compound and a polyoxyethylene compound are further added. Although the order of addition is not critical for these latter two compounds, the tetrazaindene compound should be added first mainly from the practical point of view, and more preferably after the end of the second ripening of the photographic emulsion to a point immediately before the coating of the photographic emulsion.

In the present invention, suitable hydroxytetrazaindene compounds include those represented by the following general formula I

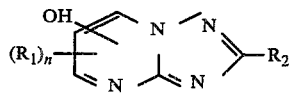

(I)

wherein $R_1$ and $R_2$ each represents a hydrogen atom, an alkyl group (e.g., a methyl, ethyl, propyl, butyl, etc. group and a methyl, ethyl, propyl, butyl, etc. group substituted with hydroxyl or carboxyl groups), or an aryl group (e.g., a phenyl group, a phenyl group substituted with a methyl, ethyl, propyl, butyl, and other alkyl groups, with a halogen atom such as Cl, Br, I, etc. or with a hydroxyl group), and *n* represents a positive integer of from 1 to 2. More preferable hydroxytetraindenes have a hydroxyl group at the 4-position of the formula (I), in which the substituent $R_1$ can be attached to the 6-position. A suitable carbon chain length range for the alkyl group for $R_1$ and $R_2$ and the alkyl group substituent of the phenyl group is 1 to 4 carbon atoms.

The hydroxytetrazaindene compound of this invention exhibits a marked effect interacting with the water soluble iridium compound and the polyoxyethylene compound provided that the order and the period of addition of the hydroxytetrazaindene compound complies with the above described conditions. There are no limitations imposed on the type of hydroxytetrazaindene compound since all hydroxytetrazaindene compounds exhibit such an interaction. Specific examples of hydroxytetrazaindene compounds, which are also disclosed in U.S. Pat. Nos. 2,716,062, 2,784,091, British Pat. No. 981,470, etc., include;

Compound I
4-Hydroxy-6-methyl-1,3,3a,7-tetrazaindene,
Compound II
4-Hydroxy-1,3,3a,7-tetrazaindene,
Compound III
4-Hydroxy-6-phenyl-1,3,3a,7-tetrazaindene,
Compound IV
4-Methyl-6-hydroxy-1,3,3a,7-tetrazaindene,
Compound V
4-Hydroxy-6-benzyl-1,3,3a,7-tetrazaindene,
Compound VI
2-Methyl-4-hydroxy-6-butyl-1,3,3a,7-tetrazaindene,
Compound VII
4-Hydroxy-6-carboxymethyl-1,3,3a,7-tetrazaindene,
Compound VIII
2-Hydroxymethyl-4-hydroxy-6-phenyl-1,3,3a,7-tetrazaindene,
Compound IX
2-(4-Chloro-2-methyl-phenoxymethyl)-4-hydroxy-1,3,3a,7-tetrazaindene,
Compound X
2-Methyl-4-hydroxy-6-ethoxycarbonylmethyl-1,3,3a,7-tetrazaindene, etc.

Among the above described compounds, the 4-hydroxy-1,3,3a,7-tetrazaindenes are most preferred, in which Compound I is particularly advantageous. The amount of the hydroxytetrazaindene compound should preferably range from about $10^{-4}$ to $10^{-2}$ mole, and more preferably from $5 \times 10^{-4}$ to $5 \times 10^{-3}$ mole, per mole of silver halide. The hydroxy tetrazaindene compound can be added to a silver halide emulsion in a similar manner as other photographic additives. For example, the compound can be dissolved in a solvent (e.g., water or an alkaline aqueous system) which exerts no deleterious effects on the finally obtained photographic sensitive material, and then the resulting solution is added to the emulsion after the end of the second ripening and a point just prior to coating.

In the present invention, suitable polyoxyethylene compounds include those polyoxyethylene compounds having 5 or more ethyleneoxy groups, including a condensation produce of ethylene oxide with an aliphatic alcohol, a glycol, a carboxylic acid, an aliphatic amine, a phenolic compound or a dehydrated cyclic compound from a hexitol derivative, etc., or a block copolymer of polyoxyethylene and polyoxypropylene. Detailed descriptions of suitable polyoxyethylene compounds are in U.S. Pat. Nos. 2,400,532, 3,142,568, 3,259,540, 3,288,612, 3,294,540, 3,345,175, 3,516,830, 3,567,458, etc.

A preferable range of molecular weight of the polyoxyethylene compound for use in the present invention ranges from about 300 to 50,000, and a more preferred range is from 800 to 20,000. When the compound is a block copolymer of polyoxyethylene and polyoxypropylene, the copolymer should preferably be represented by the following general formula (II)

$$Y[(C_3H_6O)_m—E—R]_x \quad \text{(II)}$$

wherein Y represents a di- or higher valent organic residue having a valence of $n$, the residue being the residue of an organic compound containing atoms selected from the group consisting of carbon, hydrogen, oxygen, nitrogen and sulfur with $n$ active hydrogen atoms, such as, the residue of a polyhydroxy compound, e.g., ethylene glycol, 1,2-propanediol, 1,5-pentanediol, 1,2,3-propanetriol, sucrose, etc., the residue of a polybasic acid, e.g., oxalic acid, malonic acid, succinic acid, maleic acid, citric acid, etc., the residue of a polyamine, e.g., ethylenediamine, 1,3-diaminopropylene, etc., the residue of a polyamide, e.g., malonamide, succinamide, etc., the residue of a polythiol, e.g., 1,2-ethylenedithiol, 1,3-propylenedithiol, etc., $n$ is an integer of not less than 2; $m$ represents a positive integer of not less than 2; $x$ and $m$ are selected so that the molecular weight of the $(C_3H_6O)_m$ moieties ranges from about 800 to 3500; E represents a polyoxyethylene chain comprising about 10 to 90% by weight of the block copolymer; and R represents a hydrogen atom, an alkyl group having 1 to 20 carbon atoms (such as a methyl, propyl, decyl, dodecyl, octadecyl, etc. group), an alkylcarbonyl group in which the alkyl moiety has from 1 to 20 carbon atoms as described above, an arylcarbonyl group, such as, benzoyl, p-methylbenzoyl, etc.

Of the compounds expressed by general formula (II), particularly useful compounds are those compounds represented by the Formula III $$HO\text{-}(CH_2CH_2O)_a\text{-}(CH(CH_3)CH_2O)_b\text{-}(CH_2CH_2O)\text{-}H \quad \text{(III)}$$

wherein $b$ represents a positive integer of from 16 to 57, $a$ and $c$ each represents a positive integer such that $a + c$ ranges from 7 to 295, and the total of the polyoxyethylene chain comprises about 10 to 90% by weight of the block copolymer. Some specific examples of these compounds are described below but the invention is not to be construed as being limited to these compounds.

Compound A $$HOCH_2CH_2O\text{-}(CH_2CH_2O)_{50}CH_2CH_2OH$$

Compound B $$HOCH_2CH_2O\text{-}(CH_2CH_2O)_{100}CH_2CH_2OH$$

Compound C $$HOCH_2CH_2(OCH_2CH_2)_{10}O\text{-}(CH_2)_{10}O\text{-}(CH_2CH_2O)_{10}CH_2CH_2OH$$

Compound D $$HOCH_2CH_2O\text{-}(CH_2CH_2O)_{25}C_{17}H_{35}$$

Compound E

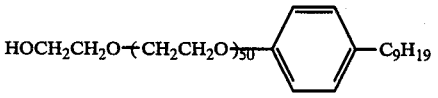

Compound F $$HOCH_2CH_2(OCH_2CH_2)_{50}NHC_{12}H_{25}$$

Compound G $$HOCH_2CH_2O\text{-}(CH_2CH_2O)_{40}CO\text{-}(CH_2)_7CH{=}CHC_8H_{17}$$

Compound H

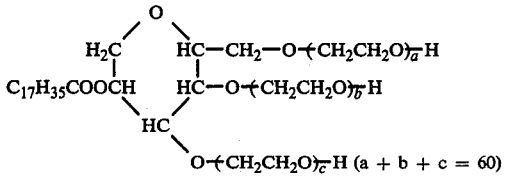

Compound I $$H\text{-}(OCH_2CH_2)_a\text{-}(OCH_2CH(CH_3))_b\text{-}(OCH_2CH_2)\text{-}OH \quad (a + c = 26,\ b = 31)$$

Compound J $$H\text{-}(OCH_2CH_2)_a\text{-}(OCH_2CH(CH_3))_b\text{-}(OCH_2CH_2)_c\text{-}OH \quad (a + c = 205,\ b = 40)$$

The polyoxyethylene compound can be added to the emulsion in a manner similar to the hydroxytetrazaindene described above and in an amount of from about 0.01 to 1.0 g, more preferably from 0.05 to 0.5 g, per mole of silver halide.

Since the silver halide emulsion used in the present invention needs to have a high gamma value, at least about 60 mole % of the silver halide must be silver chloride. In particular a chloride content not less than 75 mole % is especially preferred, since a higher chloride content results in a higher gamma. Hence, the silver halide composition used in the present invention is selected from silver chloride, silver chlorobromide, silver chloroiodide and silver chloroiodobromide. Where a halide other than chloride is employed, a bromide content not higher than about 40 mole% (more preferably 25 mole%) and an iodide content of not higher than about 8 mole% (more preferably 5 mole%) are preferred.

The silver halide grains to be used can be in any crystalline form including cubic, octahedral or mixtures thereof. The grain size, which lies generally in the range of from about 0.04 to 1 micron, should preferably not be larger than 0.7 micron and more preferably ranges from 0.1 to 0.7 micron.

Such silver halide crystals can be prepared using any of the known, conventional techniques including the single and double jet processes or the control double jet process.

Further, more than two silver halide emulsions, each separately prepared, can be mixed if desired. In addition, the silver halide grains can have a uniform crystalline structure throughout the entire grain, or can have a surface structure which is different from the inside of the grain, or can be of the conversion type as is described in British Pat. No. 635,841 and U.S. Pat. No. 3,622,318. Also the silver halide grains can be either of the type that can form a latent image primarily on the surface of the grains or that of the so-called internal latent image forming type in which a latent image is formed in the interior of the grains. These various types of photographic emulsions are well known in the art and are described, for example, in C. E. K. Mees & T. H. James *The Theory of the Photographic Process,* MacMillan Co., New York (1966), P. Glofkides *Chimie Photographique,* Paul Montel Co., Paris (1957), etc., and can be prepared by a variety of methods well known in the art, including neutral, acidic and other processes.

Silver halide photographic emulsions contain a hydrophilic colloid including, for example, gelatin, colloidal albumin, casein, cellulose derivatives such as hydroxyethylcellulose, carboxymethylcellulose, etc., carbohydrate derivatives such as agar-agar, sodium alginate or starch derivatives, a synthetic hydrophilic colloid such as polyvinyl alcohol, copolymers of acrylic acid, polyacrylamide, derivatives of these polymers, partially hydrolyzed products of these polymers, etc. Depending on the particular requirements, more than two of these compounds which are compatible with each other can be used. Of these colloids, gelatin, which may be partly or completely replaced with synthetic polymers, is most generally used. Further the gelatin can be modified with suitable compounds which react with the amino, imino, hydroxyl or carboxyl groups contained in the gelatin molecules or other polymer chains can be grafted onto the gelatin molecule to produce a grafted gelatin. Suitable chemical compounds which can be used to modify gelatin include the isocyanates, acyl chlorides and acid anhydrides as described in U.S. Pat. No. 2,614,928, the acid anhydrides as disclosed in U.S. Pat. No. 3,118,766, bromoacetic acid and its derivatives as described in Japanese Patent Publication No. 5514/1964, phenyl glycidyl ether and related compounds as described in Japanese Patent Publication No. 26845/1967, the vinyl sulfones as described in U.S. Pat. No. 3,132,945, the N-allyl vinyl sulfones as described in British Pat. No. 861,414, the maleinimides as described in U.S. Pat. No. 3,186,846, the acrylonitriles as described in U.S. Pat. No. 2,594,293, the polyalkylene oxides as described in U.S. Pat. No. 3,312,553, the epoxy compounds as described in Japanese Patent Publication No. 26845/1967, the esters as described in U.S. Pat. No. 2,763,639, the alkane sultones as are described in British Pat. No. 1,033,189, etc. Polymer chains which can be grafted to gelatin are described in various references including U.S. Pat. Nos. 2,763,625, 2,831,767, and 2,956,884, *Polymer Letters* 5, 595 (1967), *Photo. Sci. Eng.* 9, 148 (1965), *J. Polymer Sci.,* A-1, 9, 3199 (1971), etc., with the most widely used polymer chains being homo- and copolymers of vinyl monomers including acrylic acid, methacrylic acid, acrylates and methacrylates, acryl- and methacrylamides, acrylo- and methacrylonitriles, or styrene.

In the present invention, synthetic polymer materials, e.g., vinyl polymer latexes, which are particularly effective to improve the dimensional stability of the final photographic product can be incorporated into the photographic emulsion layers and other related layers. Such synthetic materials can be used individually or, in combination, or further can be used together with a hydrophillic water-permeable colloid. Descriptions of suitable polymer materials are described, for example, in U.S. Pat. Nos. 2,376,005, 2,739,137, 2,853,457, 3,062,674, 3,142,568, 3,411,911, 3,488,708, 3,516,830, 3,525,620, 3,635,715, 3,607,290, and 3,645,740; British Pat. Nos. 1,186,699, and 1,307,373. Suitable polymers which are most widely and generally used include homo- and copolymers selected from alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylates, alkoxyalkyl acrylates, alkoxyalkyl methacrylates, styrene, butadiene, vinyl chloride, vinylidene chloride, maleic anhydride, and itaconic anhydride. In utilizing vinyl polymers prepared by emulsion polymerization, the so-called graft-type emulsion polymerized latexes, which are prepared in the presence of a hydrophilic protective colloid, can also be used.

The above-described photographic silver halide emulsions can also be chemically sensitized using any conventional method. Suitable chemical sensitizing agents include gold compounds (e.g., chloroaurate salts or auric trichloride) which are described in U.S. Pat. Nos. 2,399,083, 2,540,085, 2,597,856, 2,597,915, etc., sulfur compounds capable of reacting with silver salts to produce silver sulfide as described in U.S. Pat. Nos. 1,574,944, 2,410,689, 3,189,458, 3,501,313, etc., and stannous salts, amines and other reducing materials, as described in U.S. Pat. Nos. 2,487,850, 2,518,698, 2,512,925, 2,521,926, 2,694,637, 2,983,610, and 3,201,254.

Other additives to prevent desensitization as well as fog generation which might take place during production, storage and processing can further be added to the above-described silver halide emulsions. Such additives, well known in the art, include heterocyclic compounds (e.g., 3-methylbenzothiazole, 1-phenyl-5-mercaptotetrazole, etc.), mercury compounds, mercapto compounds, metal salts and other large numbers of compounds. Suitable additives are described in C. E. K. Mees and T. H. James *The Theory of the Photographic Process,* supra, and original references cited therein, and also in the following patents; U.S. Pat. Nos. 1,758,576, 2,110,178, 2,131,038, 2,173,628, 2,697,040, 2,304,962, 2,324,123, 2,394,198, 2,694,716, 2,697,099, 2,708,162, 2,728,663–665, 2,476,536, 2,824,001, 2,843,491, 3,052,544, 3,137,577, 3,220,839, 3,236,231, 3,236,652, 3,251,691, 3,252,799, 3,287,135, 3,326,681, 3,420,668, and 3,662,339, British Pat. Nos. 403,789, 1,173,609 and 1,200,188.

The photographic emulsions for use in the present invention can be spectrally sensitized and super-sensitized depending on the particular requirements of the final product, with the use of one or more cyanine dyes such as cyanine, merocyanine or carbocyanine or with the use of a cyanine with a styryl dye.

Dye sensitizing techniques are well known and are described in, for example, the following patents; U.S. Pat. Nos. 2,493,748, 2,519,001, 2,977,229, 3,480,434, 3,672,897, 3,703,377, 2,688,545, 2,912,329, 3,397,060, 3,615,635, and 3,628,964, British Pat. Nos. 1,195,302, 1,242,588 and 1,293,862, German Pat. (OLS) Nos. 2,030,326, and 2,121,780, Japanese Patent Publications Nos. 4936/1968, 14030/1969, and 10773/1968, U.S. Pat. Nos. 3,511,664, 3,522,052, 3,527,641, 3,615,613, 3,615,632, 3,617,295, 3,635,725, and 3,694,217, and British Pat. Nos. 1,137,580 and 1,216,203, etc. The dye sensitizers can be selected depending on the spectral region to be sensitized, the level of sensitivity, and the end use purpose of the final product.

Hardening of emulsions can be carried out using any conventional technique. Suitable hardening agents include aldehydes such as formaldehyde, glutaraldehyde, etc., ketones such as diacetyl, cyclopentane-dione, etc., compounds having at least one reactive halogen such as bis(2-chloroethylurea), 2-hydroxy-4,6-dichloro-1,3,5-triazine and those described in U.S. Pat. Nos. 3,288,775, and 2,732,303, and British Pat. Nos. 974,723 and 1,167,207, compounds having at least one reactive olefinic group such as divinyl sulfone, 5-acetyl-1,3-diacrylohexahydro-1,3,5-triazine, and those described in U.S. Pat. Nos. 3,635,718, and 3,232,763, and British Pat. No. 994,869, N-methylol compounds such as N-hydroxymethylphthalimide and those described in U.S. Pat. Nos. 2,732,316 and 2,586,168, the isocyanates disclosed in U.S. Pat. No. 3,103,437, the aziridine compounds disclosed in U.S. Pat. Nos. 3,017,280 and 2,983,611, the acid derivatives as disclosed in U.S. Pat. Nos. 2,725,294 and 2,725,295, the carbodiimides disclosed in U.S. Pat. No. 3,100,704, etc., the epoxy compounds as described in U.S. Pat. No. 3,091,537, the isoxazole compounds as described in U.S. Pat. Nos. 3,321,313 and 3,543,292, halocarboxy aldehydes such as mucochloric acid, dioxane derivatives such as dihydroxydioxane, dichlorodioxane, etc., and inorganic compounds such as chrome alum and zirconium sulfate. In addition, precursers of these hardening agents can also be utilized, including alkali metal bisulfitealdehyde adducts, a methylol derivative of hydantoin, primary aliphatic nitro alcohols, etc.

The photographic emulsion used for the present invention can also contain one or more surface active agents, which are primarily used to improve the coating characteristics of the emulsion, but sometimes for other purposes such as emulsifying and dispersion, improvement of photographic properties, improving antistatic characteristics, and prevention of blocking. Suitable surfactants can be classified into four groups; natural surfactants such as saponin, etc., cationic surfactants such as higher alkyl amines, pyridine and other heterocyclic compounds, phosphonium and sulfonium compounds, etc., anionic surfactants containing acid groups such as carboxylic acid, sulfonic acid, phosphoric acid, sulfate ester or phosphate ester groups, etc., and amphoteric surfactants such as amino acids, aminosulfonic acid, the sulfate or phosphate esters of amino alcohols, etc. Specific examples which are applicable to the emulsions of the present invention are described in U.S. Pat. Nos. 2,271,623, 2,288,226, 2,739,891, 3,201,253 and 3,475,174, German Pat. (OLS) No. 1,942,665, British Pat. No. 1,077,317, Ryohei Oda et al., *Kaimen Kasseizai no Gosei to sono Ohyo* (*Sythesis and Application of Surface Active Agents*), published by Maki Shoten (1964), A. W. Schwartz et al., *Surface Active Agents* published Interscience Publication Inc. (1958) and J. P. Sisly, *Encyclopedia of Surface Active Agents* published by Chemical Publishing Co. (1964).

A certain class of quaternary ammonium salts, 3-pyrazolidone compounds (as disclosed in U.S. Pat. No. 3,518,085), and the compounds described in U.S. Pat. No. 3,345,175 can be added to photographic emulsions for the purpose of development promotion, improvement of dot quality, contrast and development latitude.

The photographic emulsion of the present invention is coated on a flexible support which shows little dimensional change during processing. Typical flexible supports include films of cellulose nitrate, cellulose acetate, cellulose acetate butyrate, cellulose acetate propionate, polystyrene, poly(ethylene terephthalate), and polycarbonate; further, laminates comprising two or more of these synthetic resins can also be used. Where the adhesion between the support and the photographic emulsion layer is insufficient, a subbing layer, which has good affinity for both of the support and the emulsion layer, is usually provided on the support. In addition, to enhance the adhesion, the surface of the support can be treated with a corona discharge, ultraviolet radiation, or a flame treatment.

An anti-halation or a filter layer can be provided adjacent, thereon or thereunder, the emulsion layer of the present invention.

The silver halide photographic material prepared according to the present invention can be processed by processing methods well known in the art. To develop the material an infectious developer is employed. In general, an infectious developer basically comprises a dihydroxybenzene as a primary developing agent, an alkali, a small amount of a sulfite salt and a sulfite ion buffer. The primary developing agent can be selected from dihydroxybenzenes well known in the photographic field including hydroquinone, chlorohydroquinone, bromohydroquinone, isopropylhydroquinone, toluhydroquinone, methylhydroquinone, 2,3-dichlorohydroquinone, 2,5-dimethylhydroquinone, etc. Of these, hydroquinone is particularly preferred. These developing agents can be used individually or as mixtures.

Suitable sulfite ion buffers, which are used in such a concentration that the sulfite ion concentration in the developer is sufficiently low, include aldehyde-alkali bisulfite adducts such as formaldehyde-alkali metal bisulfite adducts, ketone-alkali metal bisulfite adducts such as acetone-sodium bisulfite adduct, and carbonyl bisulfite-amine condensates such as sodium bis(2-hydroxyethyl)aminomethane sulfonate.

The alkaline compounds are added to maintain the developer alkaline and more preferably not lower than a pH of about 9.

The developer can further contain other additives well known in the art including an organic anti-foggant such as 5- or 6-nitroimidazole, benzotriazole, 1-phenyl-5-mercaptotetrazole, an amino compound, and an organic solvent such as triethylene glycol, dimethylformamide, methanol, ethylene glycol monoalkyl ether, etc.

The methods and the processing agents to process the photographic material prepared in accordance with the present invention are described in detail in the following patents: U.S. Pat. Nos. 3,038,801, 3,512,981, 3,573,914, 3,625,689, 3,615,524, 3,600,174, 3,294,540 and 3,516,524, and British Pat. No. 1,163,724. A processing apparatus of the roller conveying type capable of continuous processing can be used, as described in U.S. Pat. Nos. 3,025,779, 3,028,024, 3,122,086, 3,156,173 and 3,224,356.

As has been described hereinbefore, the present invention has achieved an improvement in pressure susceptibility of lithographic materials by introducing an iridium compound near the surface of silver halide crystals, and by later incorporating a hydroxytetrazaindene and a polyoxyethylene compound in the emulsion. If the hydroxytetrazaindene compound is not used in combination, the presence of the iridium compound near the silver halide crystal surface does not result in a marked improvement in pressure susceptibility. Also the sole use of a hydroxytetrazaindene compound failed to achieve as good an effect as when an iridium compound was used in combination. Further, the degree of improvement is particularly prominent when a polyoxyethylene compound is added. In other words, according to the present invention, for a lith-type photographic material containing a polyoxyethylene compound, only with the combined use of an iridium and a hydroxytetrazaindene compound can the pressure susceptibility be improved to a marked extent.

The lith-type photographic material of the present invention, despite the absence of a cadmium salt which has been prevalent in prior art materials, is effectively protected from the generation of pressure and scratch marks. Further, the present invention can provide photographic lith films having a high photographic speed, a high gamma value, and a superior dot quality. Moreover, the lith films of the present invention have a wide exposure latitude as well as development latitude, an improved storage stability and still other advantageous features.

In the following, specific examples of the present invention are given. Unless otherwise indicated, all parts, percents, ratios and the like are by weight.

EXAMPLE 1

Emulsions were prepared according to the following formulation and procedures.

| | |
|---|---|
| Solution I | |
| Gelatin | 20 g |
| Potassium Bromide | 3 g |
| Sodium Chloride | 8 g |
| Potassium Iodide | 1 g |
| Water | 600 cc |
| Solution II | |
| Silver Nitrate | 100 g |
| Water | 400 cc |
| Solution III | |
| Potassium Bromide | 9 g |
| Sodium Chloride | 24 g |
| Water | 800 cc |
| Solution IV | |
| Gelatin | 50 g |
| Water | 800 cc |
| Solution V | |
| Tripotassium Hexachloroiridium (0.05%) | 1.2 cc |
| Solution VI | |
| Hydrochloroauric Acid (0.1%) | 2 cc |
| Potassium Thiocyanate (1%) | 5 cc |

Into Solution I kept at 60° C. under agitation were added Solutions II and III simultaneously over a 10 minute period. After 20 minutes ripening at the same temperature, the solid ingredients were precipitated by a gelatin coagulating agent. The precipitate was washed with water. To the redispersed coagulated mass, Solutions IV, V and VI were added in this order. Ripening at 60° C. for 1 hour was carried out to produce Emulsion A. For the purposes of comparison, another emulsion (Emulsion B) was prepared in the same manner except that Solution V was omitted from the above formulation. Three coating mixtures were prepared from each of Emulsion A and B with and without the addition of a hydroxytetrazaindene compound (Compound I) in an amount of 30 cc of a 1% aqueous solution and polyoxyethylene compound (Compound E) in an amount of 10 cc of a 1% aqueous solution, each per mole of Ag, and by further adding a suitable amount of a spectral sensitizer (3-carboxymethyl-5-[2-(3-ethylthiazolinidene)ethylidene]rhodanine), a hardening agent (mucochloric acid), a coating assistant (sodium dodecylbenzenesulfonate), etc. Each of the mixtures was coated on a poly-(ethylene terephthalate) film, and the dried layer was overcoated with a gelatin protective layer hving a thickness of 1.0μ to produce the samples listed in Table I.

Table I

| Sample No. | Emulsion | Ir Compound ($K_3IrCl_6$) | Tetrazaindene (Compound I) | Polyoxyethylene (Compound E) |
|---|---|---|---|---|
| | | (cc) | (cc) | (cc) |
| 1 | A | 12 | 30 | 10 |
| 2 | " | 12 | 30 | 0 |
| 3 | " | 12 | 0 | 10 |
| 4 | " | 12 | 0 | 0 |
| 5 | B | 0 | 30 | 10 |
| 6 | " | 0 | 30 | 0 |
| 7 | " | 0 | 0 | 10 |
| 8 | " | 0 | 0 | 0 |

The pressure susceptibility of the eight samples thus prepared was compared using the following procedure. First, a sharp stylus having a spherical tip with a radius of 0.05 mm was pressed against the emulsion coating with a weight of 30 g, and moved at a constant speed to produce a line-shaped pressed area in the coating. Then the pressed film was exposed to an optical wedge for 5 sec. using a 500W incandescent lamp which was operated at 80V with a color temperature conversion filter (5400° K.), whereby the direction along which the wedge density changes coincided with the longitudinal direction of the pressed area of the sample. The exposed film was developed with the following developer at 20° C. for 3 minutes, fixed, washed, dried, and then checked as for pressure mark penetration.

| Developer Composition | |
|---|---|
| Sodium Carbonate (monohydrate) | 50 g |
| Formaldehyde-Sodium Bisulfite Adduct | 45 g |
| Potassium Bromide | 2 g |
| Hydroquinone | 18 g |
| Sodium Sulfite | 2 g |
| Water to make | 1000 liter |

Two characteristic curves were obtained by measuring the optical densities at the pressed area with a microphotometer and those at the ordinary, remaining area with an ordinary densitometer. The pressure susceptibility of each sample was evaluated by comparing the sensitivity and gamma for these curves. The results obtained are shown in Table II and in the figure.

Table II

| Sample No. | Relative Speed | | Gamma | |
|---|---|---|---|---|
| | Not Pressed Area | Pressed Area | Not Pressed Area | Pressed Area |
| 1 | 100 | 100 | 19.2 | 19.0 |
| 2 | 166 | 155 | 4.1 | 3.9 |
| 3 | 43 | 6.1 | 17.3 | 11.0 |
| 4 | 91 | 26 | 3.8 | 1.2 |
| 5 | 100 | 41 | 19.6 | 19.1 |
| 6 | 169 | 88 | 4.1 | 3.8 |
| 7 | 41 | 3.2 | 15.5 | 5.2 |
| 8 | 69 | 11 | 3.4 | 0.4 |

The relative speed is expressed by setting the speed of Sample No. 1 at the unpressed area equal to 100.

Comparison of Samples No. 7 and No. 8 which do not contain a water soluble iridium salt nor a hydroxytetrazaindene compound shows that the pressed area of the Sample No. 8 is desensitized and at the same time exhibits a reduction in contrast. On the other hand, Sample 7 which is different from Sample 8 in that Sample 7 contains a polyoxyethylene compound is more markedly desensitized by pressure. When Samples No. 5 and No. 6 which contain a hydroxytetrazaindene compound but no iridium salt are now compared with Samples No. 7 and No. 8, it can be seen that Sample No.

5 has a higher speed and a greater gamma than the corresponding Sample No. 7, which is also the case for Samples No. 6 and No. 8. Further, the degree of desensitization by pressure is fairly suppressed for both Samples No. 5 and No. 6, but yet insufficiently. Similarly Sample Nos. 3 and 4, to which the iridium salt was added but no hydroxytetrazaindene compound was added, are improved as for pressure desensitization compared with Sample Nos. 7 and 8. However, in comparison with Sample Nos. 5 and 6, a gamma reduction is severe with no polyoxyethylene compound (Sample No. 4), while, with the polyoxyethylene, desensitization increases (Sample No. 3).

On the contrary, between the samples containing both of the iridium salt and the hydroxytetrazaindene compound, Sample No. 2, which does not contain polyoxyethylene, is almost completely free from pressure desensitization, but still suffers from a reduction in gamma; Sample No. 1, which is prepared according to the present invention containing the polyoxyethylene compound, can be regarded as almost perfect, inhibiting pressure desensitization as well as a reduction in gamma.

EXAMPLE 2

Emulsions were prepared according to the following formulations and procedures.

| | |
|---|---|
| Solution I | |
| Gelatin | 20 g |
| Sodium Chloride | 4 g |
| Potassium Iodide | 2 g |
| Water | 400 cc |
| Solution II | |
| Silver Nitrate | 100 g |
| Water | 400 cc |
| Solution III | |
| Potassium Bromide | 18 g |
| Sodium Chloride | 25 g |
| Water | 1000 cc |
| Solution IV | |
| Dipotassium Hexachloroiridium (0.05%) | 6 cc |
| Solution V | |
| Gelatin | 50 g |
| Water | 800 cc |
| Solution VI | |
| Hydrochloroauric Acid (0.1%) | 2.5 cc |
| Potassium Thiocyanate (1%) | 5 cc |

Into Solution I kept at 64° C. under stirring were added Solutions II and III simultaneously over a 10 minute period. After 10 minutes ripening at the same temperature, Solution IV was added, and another 5 minute ripening followed. The solid ingredients were collected using a gelatin coagulating agent, and washed with water. After redispersion of the collected mass, Solutions V and VI were added to the dispersion. Ripening at 62° C. for 70 minutes was carried out to produce Emulsion C. Another emulsion (Emulsion D) was prepared in the same manner except that Solution IV was not employed. Three coating mixtures were prepared based on each of Emulsion C and D with and without the addition of a hydroxytetrazaindene compound (Compound I) in an amount of 33 cc of a 1% aqueous solution and a polyoxyethylene compound (Compound A) in an amount of 14 cc of a 1% aqueous solution, each per mole of Ag, and by further adding a suitable amount of a dye sensitizer, a hardening agent, coating assistants, etc. as in Example 1. Each mixture was coated on a poly(ethylene terephthalate) film, and the dried coating was overcoated with a protective layer to produce the samples listed in Table III.

Table III

| Sample No. | Emulsion | Ir Compound ($K_2IrCl_6$) | Tetrazaindene (Compound I) | Polyoxyethylene (Compound A) |
|---|---|---|---|---|
| | | (cc) | (cc) | (cc) |
| 9 | C | 6 | 35 | 14 |
| 10 | " | 6 | 35 | 0 |
| 11 | " | 6 | 0 | 14 |
| 12 | " | 6 | 0 | 0 |
| 13 | D | 0 | 35 | 14 |
| 14 | " | 0 | 35 | 0 |
| 15 | " | 0 | 0 | 14 |
| 16 | " | 0 | 0 | 0 |

Each of the eight samples obtained was folded to a radius of curvature of 1.2 mm with the emulsion coated side facing inward. The folded samples were exposed, and processed following the same condition as described in Example I. The densities were measured by using a microtracing photometer at the folded and unfolded portions to obtain the results listed in Table IV. The relative speed is defined as in Example 1. As in Example 1, only the sample prepared according to the present invention is perfectly free from pressure desensitization and a reduction in gamma.

Table IV

| Sample No. | Relative Speed | | Gamma | |
|---|---|---|---|---|
| | Unfolded Area | Folded Area | Unfolded Area | Folded Area |
| 9 | 100 | 100 | 18.0 | 18.0 |
| 10 | 148 | 145 | 4.3 | 4.2 |
| 11 | 68 | 21 | 16.2 | 11.5 |
| 12 | 98 | 43 | 3.9 | 1.6 |
| 13 | 98 | 61 | 18.5 | 17.9 |
| 14 | 150 | 78 | 4.3 | 4.1 |
| 15 | 67 | 15 | 15.8 | 6.2 |
| 16 | 91 | 26 | 3.2 | 0.9 |

While the invention has been described in detail and with reference to specific embodiments thereof, it will be apparent to one skilled in the art that various changes and modifications can be made therein without departing from the spirit and scope thereof.

What is claimed is:

1. A method of producing a lithographic photosensitive material having a high gamma value and reduced susceptibility to the effects of pressure for reproducing line and half-tone dot images comprising adding a water soluble ir idium compound to a silver halide photographic emulsion containing at least 60 mole % silver chloride in a ratio of about $10^{-6}$ to $10^{-4}$ mole of said iridium compound per mole of the silver halide in said silver halide photographic emulsion at the first or second ripening procedure of said silver halide photographic emulsion; further adding a hydroxytetrazaindene compound and a polyoxyethylene compound to said photographic emulsion; and coating the photographic emulsion on a support.

2. The method of claim 1, wherein said water soluble iridium compound is a water soluble iridium salt or a water soluble iridium complex salt.

3. The method of claim 1, wherein said water soluble iridium compound is $IrCl_3$, $IrBr_3$, $IrI_3$, $IrBr_4$, $K_3IrCl_6$, $Li_3IrCl_6$, $(NH_4)_3IrCl_6$, $K_3IrBr_6$, $Na_3IrBr_6$, $K_2IrCl_6$, $Na_2IrCl_6$, $Li_2IrCl_6$, $(NH_4)_2IrCl_6$, $Na_2IrBr_6$, $Ir(NH_3)_6(OH)_3$, $Ir(NH_3)_6(NO_3)_3$, $Ir(NH_3)_6Cl_3$, or $Ir(NH_3)_6Br_3$.

4. The method of claim 1, wherein said hydroxytetrazaindene compound has the general formula (I).

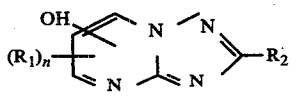

(I)

wherein $R_1$ and $R_2$ each represents a hydrogen atom, an alkyl group, or an aryl group; and $n$ is 1 or 2.

5. The method of claim 4, wherein said alkyl group is an unsubstituted alkyl group or an alkyl group substituted with a hydroxyl group or a carboxyl group and wherein said aryl group is a phenyl group or a phenyl group substituted with an alkyl group, a halogen atom, or a hydroxyl group.

6. The method of claim 4, wherein said hydroxytetrazaindene compound is 4-hydroxy-6-methyl-1,3,3a,7-tetrazaindene, 4-hydroxy-1,3,3a,7-tetrazaindene, 4-hydroxy-6-phenyl1,3,3a,7-tetrazaindene, 4-methyl-6-hydroxyl-1,3,3a,7-tetrazaindene, 4-hydroxy-6-benzyl-1,3,3a,7-tetrazaindene, 2-methyl-4-hydroxy-6-butyl-1,3,3a,7-tetrazaindene, 4-hydroxy-6-carboxymethyl-1,3,3a,7-tetrazaindene, 2-hydroxymethyl-4-hydroxy-6-phenyl-1,3,3a,7-tetrazaindene, 2-(4-chloro-2-methylphenoxymethyl)-4-hydroxy-1,3,3a,7-tetrazaindene or 2-methyl-4-hydroxy-6-ethoxycarbonylmethyl-1,3,3a,7-tetrazaindene.

7. The method of claim 1, wherein said polyoxyethylene compound is a polyoxyethylene compound having 5 or more ethyleneoxy groups.

8. The method of claim 7, wherein said polyoxyethylene compound has a molecular weight ranging from about 300 to 50,000.

9. The method of claim 7, wherein said polyoxyethylene compound is a condensation product of ethylene oxide with an aliphatic alcohol, a glycol, a carboxylic acid, an aliphatic amine, a phenolic compound or a dehydrated cyclic compound derived from a hexitol derivative, or is a block polymer of polyoxyethylene and polyoxypropylene.

10. The method of claim 1, wherein said hydroxytetrazaindene compound is added in an amount ranging from about $10^{-4}$ to $10^{-2}$ moles per mole of silver halide and said polyoxyethylene compound is added in an amount of from about 0.01 to 1 g per mole of silver halide.

* * * * *